United States Patent [19]

Fortune

[11] 4,401,350

[45] Aug. 30, 1983

[54] MODULAR STORAGE SYSTEM

[76] Inventor: William S. Fortune, 29866 Cuthbert St., Malibu, Calif. 90265

[21] Appl. No.: 310,946

[22] Filed: Oct. 13, 1981

Related U.S. Application Data

[63] Continuation-in-part of Ser. No. 259,615, May 11, 1981, which is a continuation of Ser. No. 67,841, Aug. 20, 1979, abandoned.

[51] Int. Cl.[3] ..... A47B 87/00; E05C 19/10

[52] U.S. Cl. ..... 312/107; 312/111; 312/273; 312/320; 312/333; 292/128

[58] Field of Search ..... 312/107, 111, 273, 333, 312/348, 330 R, 320; 292/128, DIG. 38

[56] References Cited

U.S. PATENT DOCUMENTS

| | | | |
|---|---|---|---|
| 922,852 | 5/1909 | Cannan | 312/333 |
| 2,245,026 | 6/1941 | Balkind | 312/111 |
| 2,245,415 | 6/1941 | Runko | 312/273 |
| 2,386,343 | 10/1945 | Regenhardt | 312/111 |
| 2,482,174 | 9/1949 | Hake | 312/330 R |
| 2,729,529 | 1/1956 | Hoven et al. | 312/245 |
| 2,807,387 | 9/1957 | Siciliano | 312/111 |
| 2,967,080 | 1/1961 | Nelson | 312/216 |
| 3,025,122 | 3/1962 | Nillman | 312/245 |
| 3,193,342 | 7/1965 | Sauter | 312/320 |
| 3,208,781 | 9/1965 | Appleberry | 292/128 |
| 3,287,075 | 11/1966 | Batke et al. | 312/111 |
| 3,554,625 | 1/1971 | Sly, Sr. | 312/330 R |
| 3,563,624 | 2/1971 | Stice | 312/111 |
| 3,567,298 | 3/1971 | Ambaum et al. | 312/111 |
| 3,680,177 | 8/1972 | Ginsberg | 312/330 R |
| 3,709,538 | 1/1973 | Seitz et al. | 292/128 |
| 3,797,870 | 3/1974 | Beckman | 292/DIG. 38 |
| 3,918,781 | 11/1975 | Paris | 312/111 |
| 3,974,898 | 8/1976 | Tullis et al. | 312/111 |
| 4,026,615 | 5/1977 | Tazaki et al. | 312/12 |
| 4,227,758 | 10/1980 | Clare | 312/111 |

*Primary Examiner*—Victor N. Sakran
*Attorney, Agent, or Firm*—Daniel T. Anderson

[57] ABSTRACT

A storage system for housing parts such as product packaging parts. The system includes a modular plurality of housings and a drawer for each housing. Each housing includes a top wall and two parallel side walls. The top wall has a plurality of alignment slots adjacent its side walls and alignment tabs extending along the lower portion of the side walls and registering with alignment slots of a housing disposed thereabove. Further, each housing has a recess on its top wall extending through a major portion of its length, and a lateral rail extending opposite the recess from a side wall and arranged to fit the recess of a laterally adjacent housing. Alignment slots on the rail permit to interconnect lateral adjacent housing. Each drawer has a bottom wall and two side walls, as well as a front and rear wall. Each drawer has a downwardly extending front portion for readily holding the drawer and pulling it out. This portion of the drawer handle is also provided with a lock for locking the drawer to its housing. Further, one or more dividers are provided for each drawer. Means are provided for holding the divider in a predetermined position within the drawer. Additionally, the divider has at least one tab which can be forced through an opening in the bottom wall of the drawer, thus holding the divider against the drawer bottom wall to prevent articles from sliding under the divider. Furthermore, there is provided a housing supporting structure of generally "U" shape which can be used to secure one housing to an adjacent housing to prevent sets of adjacent housings and drawers from separating. Finally, a handle is disclosed which serves the purpose of enabling the handcarrying of a set of housings and drawers by means of a flexible tab.

17 Claims, 20 Drawing Figures

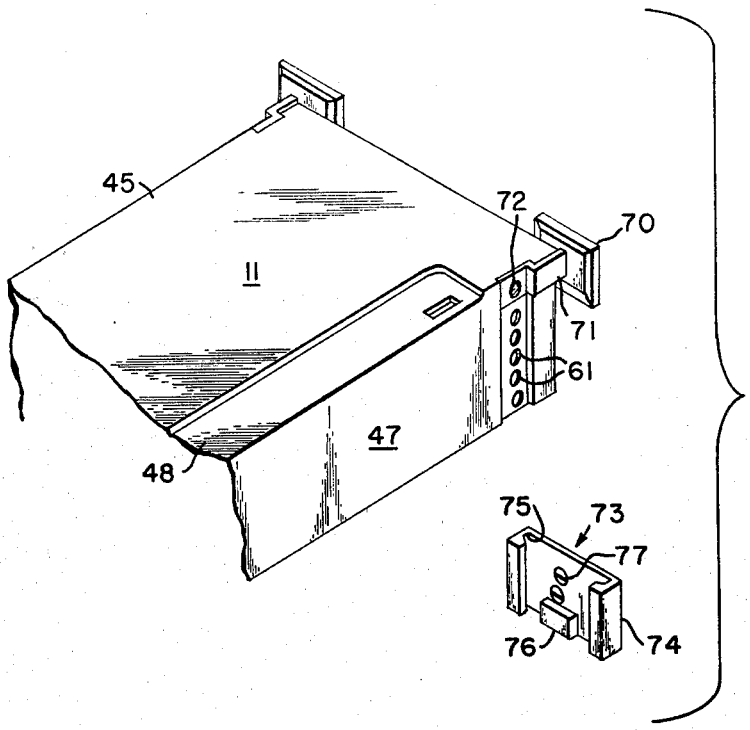
Fig. 19.
Fig. 20.
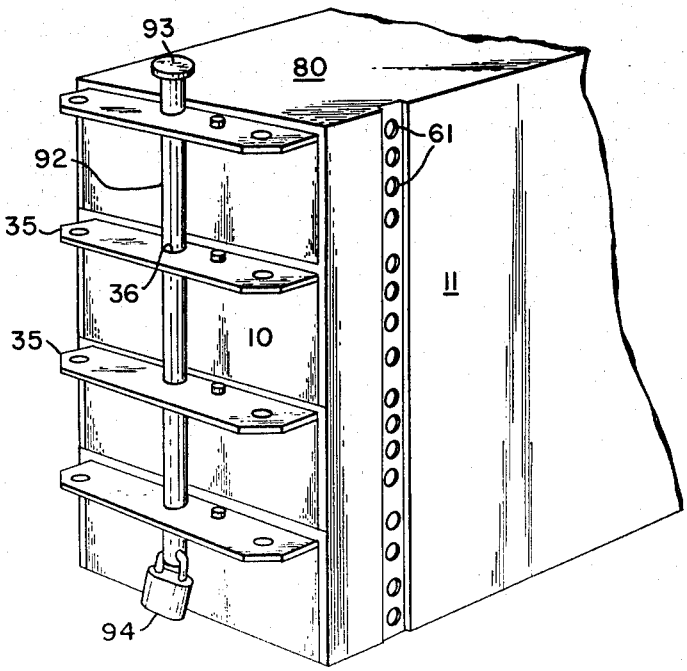

MODULAR STORAGE SYSTEM

CROSS-REFERENCES TO RELATED APPLICATIONS

This application is a continuation-in-part of the copending application, Ser. No. 259,615 of May 11, 1981, which in turn is a continuing application of the parent application Ser. No. 067,841 of Aug. 20, 1979, now abandoned, all applications having the same title, "Modular Storage System," filed in the name of William S. Fortune, Inventor.

BACKGROUND OF THE INVENTION

The invention relates to a system for storing parts such as product packaging parts. The parts are maintained in a plurality of drawers, each being insertable into a housing. Preferably, housing and drawers are made of a strong transparent substantially rigid plastic. This makes it possible to determine at a glance where a needed part is stored.

Housings and drawers form a modular system; that is, they may be interconnected in such a manner that sets of housings and drawers may be superimposed or disposed adjacent to each other without the possibility of the sets separating from each other.

There is considerable prior art concerning modular storage systems. For example, the patent to Tullis et al., U.S. Pat. No. 3,974,898, relates to a convertible suitcase which presents a structure that is not very rigid. Boxes may be put on top of each other and may be secured by interlocking members. Also, a lock mechanism may include a latch member, a channel, and bolt.

A patent to Batke, et al., U.S. Pat. No. 3,287,075, relates to a package and cabinet unit. It consists of a folded cardboard box having upwardly extending slots and fold-out tabs to fit into the slots; this will provide a self-indexing structure to lock adjacent boxes.

The U.S. Pat. No. to Swain, 4,140,355, relates to an undercounter support including two-story guide means for a drawer.

A clip member is disclosed by the Ginsberg U.S. Pat. No. 3,680,177. A movable guide is provided along the side wall of a drawer or the like for supporting a divider. The guide is vertical and may be secured to selected places in the side walls of the drawer. A display device is disclosed by Sly, Sr., U.S. Pat. No. 3,554,625. The display device is intended for coins and the like and consists of a board having shallow circular depressions for inserting the coins. The coins may be kept between transparent sheets.

The Runko U.S. Pat. No. 2,245,415 discloses a coin drawer forming part of a cash register. The coins paid by a customer may be put into the suitable circular depression and held there until the drawer is closed to release the coins by a certain mechanism. The French patent to Lalande, et al., 1,125,609 relates to a drawer having an opening in its front wall for the purpose of displaying a suitable label or marking.

A sectional cabinet structure is disclosed by Hake, U.S. Pat. No. 2,482,174. It discloses an interlocking mechanism for cabinet structures which includes suitable holes or apertures and snap fasteners for fastening adjacent cabinets to each other by utilizing the snap fasteners and their sockets. The Canadian Pat. No. to Fellowes, 578,675, also relates to storage containers having strap means for securing the containers to each other. A shelf-supported drawer is disclosed by McDonnell U.S. Pat. No. 3,712,696. It includes mounting means for securing a drawer to a shelf or bench, including a bracket or clip. A similar clip mechanism is disclosed in a U.S. Pat. No. to Pastore, 4,132,380.

It is accordingly an object of the present invention to provide a storage system for product packaging parts which may easily and inexpensively be manufactured from a clear plastic.

Another object of the present invention is to provide such a system where sets, each consisting of a drawer and a housing, may be arranged on top of each other or adjacent to each other without the possibility of the sets separating laterally, vertically or sideways.

A further object of the present invention is to provide such a system where the drawers may be inserted each into its housing in either an upper position or in a lower position to accommodate larger parts.

It is still another object of the present invention to provide a removable cover so that when the drawer is in its lower position parts are prevented from falling out of the drawer.

SUMMARY OF THE INVENTION

The modular storage system of the invention for packaging product parts comprises a plurality of housings and a drawer for each housing. Each housing includes a top wall and two parallel side walls. The top wall have a plurality of alignment slots together with alignment tabs extending downwardly from each side wall and registering with corresponding alignment slots of a housing disposed thereabove.

Each drawer has a bottom wall and two side walls, a front wall including a first horizontally extending portion and an outer portion downwardly extending at an obtuse angle with respect to the first portion for gripping and withdrawing the drawer, and a rear wall.

Finally, a locking mechanism is provided for releasably locking each drawer to its housing. The locking member extends through a substantially rectangular cut-out in said first drawer portion and an opening between said first drawer portion and said outer drawer portion. The locking member has a recess to releasably snap into a downwardly extending ridge on the front end of the housing to be held and an actuating button extending through the cut-out. A retaining portion of the member is provided which has a tight fit with the opening in the drawer, while a rearwardly extending spring member of the locking member rests on an extension of the cut-out in the drawer front for releasably securing the drawer to an associated housing.

Various other features of the invention will be subsequently discussed.

The novel features that are considered characteristic of this invention are set forth with particularity in the appended claims. The invention itself, however, both as to its organization and method of operation, as well as additional objects and advantages thereof, will best be understood from the following description when read in connection with the accompanying drawings.

BRIEF DESCRIPTION OF THE DRAWINGS

FIG. 17 is a cross-sectional view similar to that of FIG. 13, but illustrating a universal mounting device for directly connecting a housing to the lower surface of a bench or the like;

FIG. 19 is an exploded view showing an adaptor bracket and a wall mount for mounting the housing to a wall; and FIG. 20 is a view in perspective of the rear portion of a plurality of housings and drawers stacked on top of each other and including a locking rod and padlock for locking the drawers and for easy transport.

DESCRIPTION OF THE PREFERRED EMBODIMENTS

Figure 1:
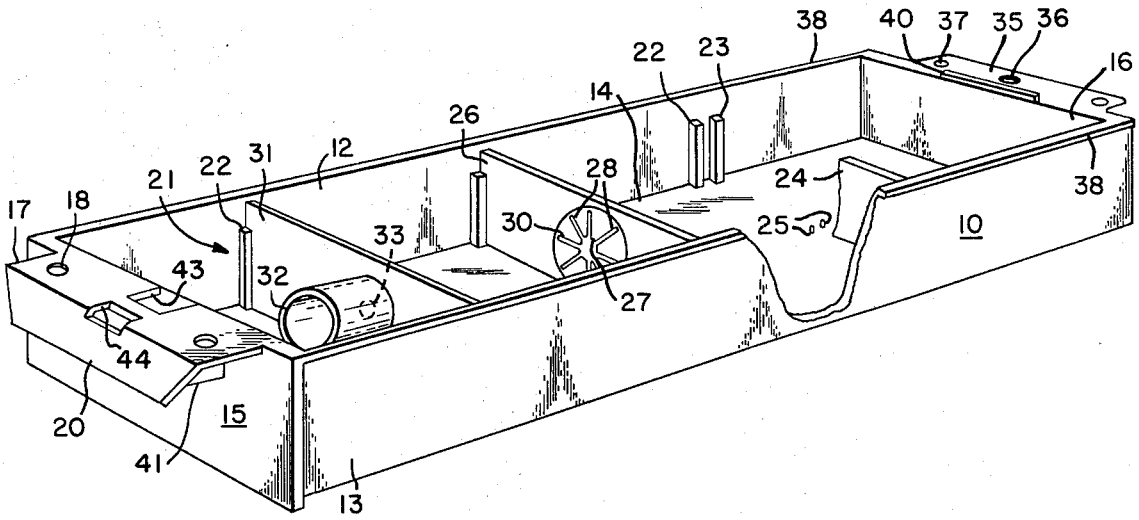
FIG. 1 is a view in perspective of a drawer, in accordance with the present invention.
Figure 2:
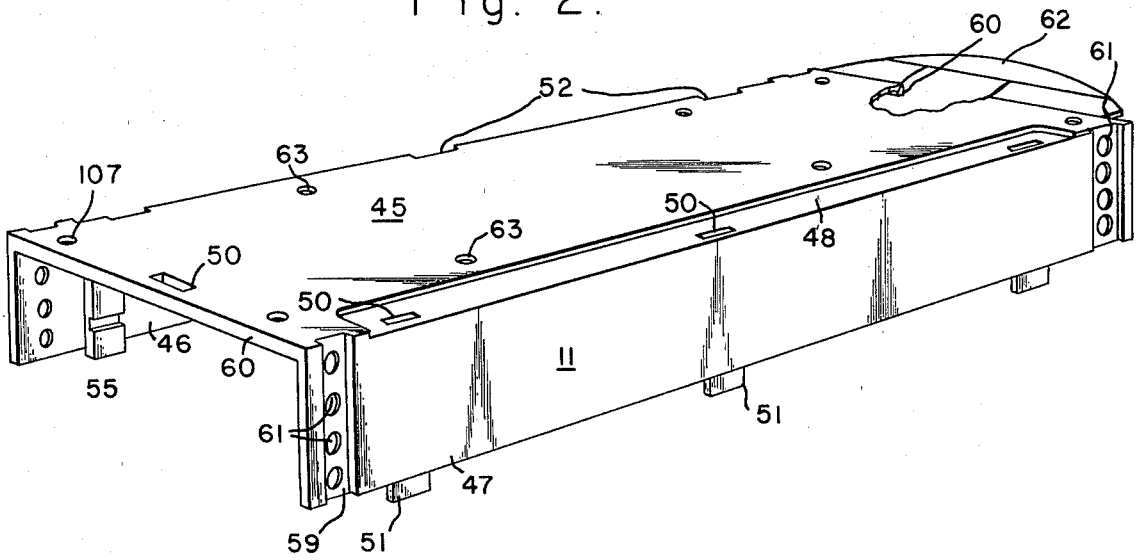
FIG. 2 is a view in perspective view of a housing embodying the present invention.
Figure 3:
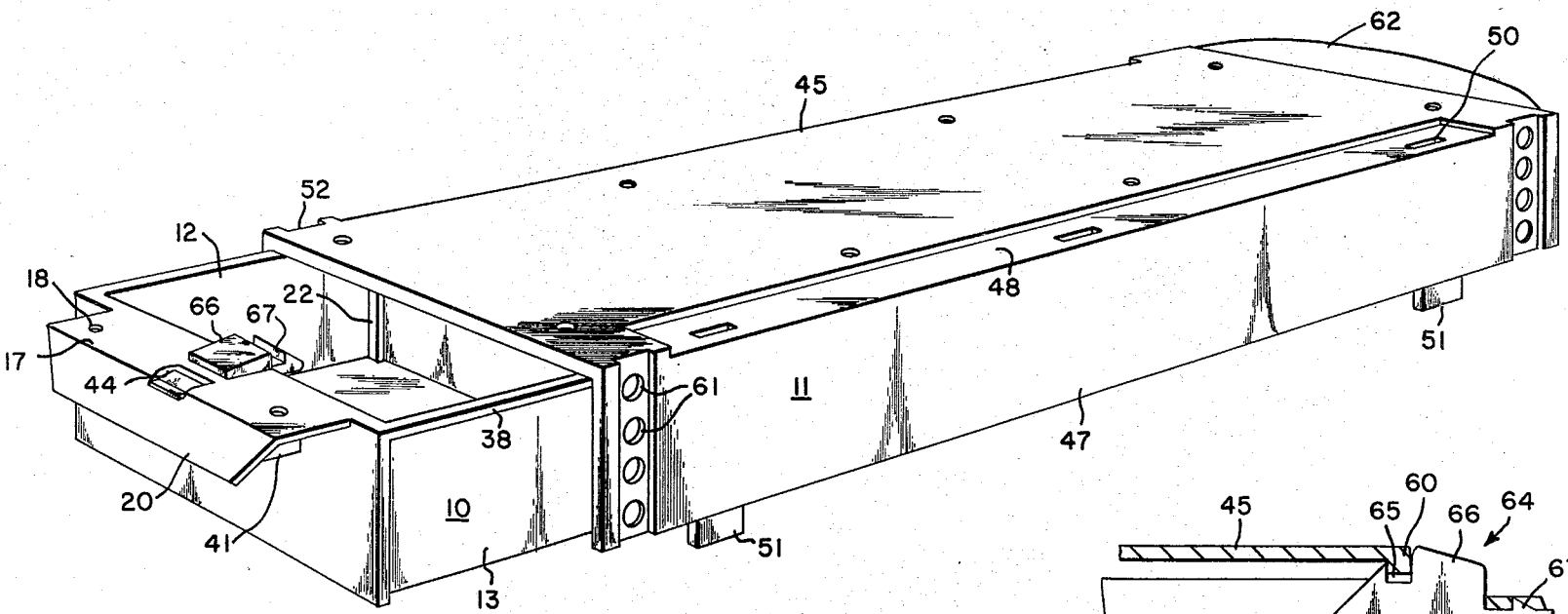
FIG. 3 is a view in perspective of a housing and a drawer extending partially from the housing.

Referring now to FIGS. 1 through 3, there is illustrated, by way of example, an embodiment of the present invention. This embodiment includes a drawer generally designated 10 and a housing indicated at 11. Drawer 10 and housing 11 are preferably injection-molded from a transparent plastic material having structural integrity. The drawer 10 has two substantially parallel side walls 12 and 13, a bottom wall 14, a front wall 15 and a rear wall 16. The front wall 15 is provided with an upper horizontally extending portion 17 which may be provided with a pair of holes 18 for a purpose to be described subsequently. Extending at an angle forwardly is a portion 20 which forms a handle by means of which the drawer may be removed from its housing 11.

Figure 4:
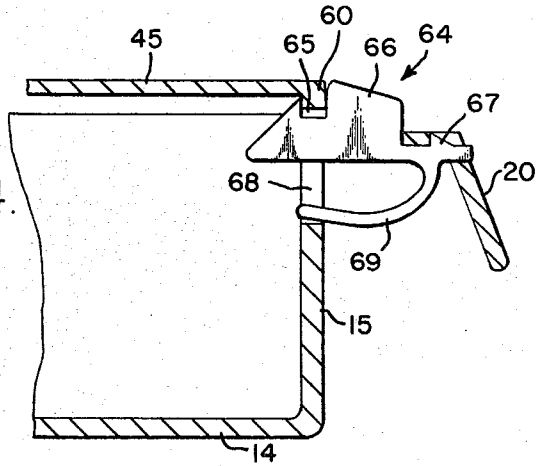
FIG. 4 is a cross-sectional view of a portion of a drawer and housing w-th a locking member for releasably securing the drawer to the housing.

Preferably but not necessarily, the horizontally extending drawer portion 15 may be provided with a substantially rectangular aperture 43 which may extend part way into the front wall 15 (as shown more clearly in FIG. 4). Furthermore, between the horizontally extending portion 17 and the downwardly extending portion 20, there may be provided a cut-out 44 of relatively small dimension, both for a purpose to be subsequently explained in connection with FIG. 4.

Disposed on each side of the side walls 12 and 13 are sets of guides such as 21 which include two parallel vertical ridges 22 and 23 between which a divider, such as 24, may be positioned. The divider 24 is, of course, removable. In order to further aid the positioning of the dividers 24 there may be provided a set of projections 25 on the bottom wall 14, spaced apart by the width of the divider. Accordingly, the divider is supported by the two ridges 22, 23 on each side wall 12 and 13 and between two projections 25.

Instead of a flat divider 24, it is also feasible to utilize a divider such as shown at 26. This divider has a central substantially circular aperture 27 and radial slots 28 extending therefrom into a circle 30. This type of divider may be used for restraining parts which may extend slightly beyond the space between one of the front or rear walls and the divider 26.

Still another type of divider is shown at 31, which is provided with a forwardly extending cylinder 32 and a central hole 33. This may be used to retain cylindrical materials or a tool such as a certain type of soldering instrument.

Figure 5:
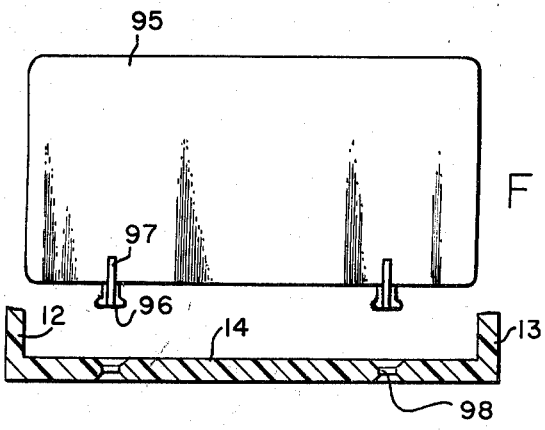
FIG. 5 is a front elevational view of a divider having two downwardly extending tabs and a portion of the bottom wall and the side walls of a drawer above in cross-section, for securing the tabs to the divider.

A preferred divider is shown in FIG. 5, to which reference will subsequently be made.

The drawer 10 is further provided with a rearwardly extending horizontal projection 35 which is at the level of the top rim of the drawer. It may have a relatively large central opening 36 and two adjacent openings 37 for a purpose to be explained hereinafter.

Adjacent the top of both side walls 12 and 13 is a longitudinally extending lateral ridge 38 which fits a set of guides on the housing which will be subsequently explained.

Additionally, the rear wall 16 of the drawer is provided with an upward extension 40 which forms a stop, together with a corresponding ridge on the housing. A reinforcing portion 41 may interconnect the lower surface of the handle 20 to the forward extension 17 of the drawer.

Turning now to the modular housing 11 (FIG. 2), this is provided with a top wall 45 and two side walls 46 and 47. The top wall 45 is provided with a lateral depression 48 which extends over the larger part of the top wall 45 along one edge thereof. Extending through the depression 48 are several rectangular alignment slots 50 which are substantially equally spaced from each other. The depression 48 of a housing 11 fits into a laterally extending rail 57 of an upper adjacent housing (see FIG. 13). Corresponding to the alignment slots 50 is a set of alignment tabs 51 which are in line with the slots 50. The alignment tabs 51 extend downwardly from the side wall 11. Similar alignment slots 52 are disposed on the opposite side of the top wall 45; that is, adjacent the side wall 46, together with corresponding alignment tabs not shown in FIG. 2.

Figure 14:
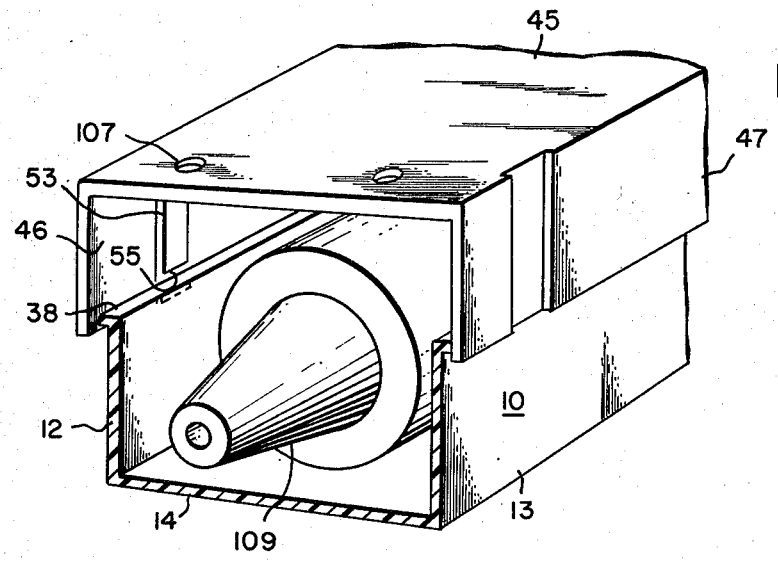
FIG. 14 is a view in perspective, parts being broken away, of a portion of a housing and drawer showing the drawer in its lower position to house a relatively large part.

Disposed in line with the alignment slots 50 and 52 and tabs 51 are lateral rails or projections (see, for example, FIG. 14) such as 53 on the two side walls 46 and 47 facing each other. These projections, in turn, are provided with two sets of horizontally extending guide or alignment slots; that is, with an upper set 54 and a lower set 55, shown particularly in FIGS. 16 and 17. The lateral ridges 38 of the drawer 10 fit into the guide slots 54 or 55, as shown in FIG. 14.

Both the front and rear ends of the top wall 45 of the housing 11 are provided with a downwardly extending ridge 60 forming a stop for the drawer extension 40 extending from the rear wall 16.

Beyond the ridge 60 and extending from the housing top wall 45, there may be provided a bumper 62. Its purpose is to protect the drawer 10, in case it should be pushed against a wall or other solid object, and also prevents accidental opening of the drawer if it should be bumped from the rear.

Additionally, the two side walls 46 and 47 of the housing 11 are provided with a plurality of holes 61 adjacent to both front and rear portion of the side walls, disposed along vertically extending recesses 59.

The top wall 45 of the housing 11 may be provided with a set of holes 63 adjacent the longer edges thereof. These holes may serve the purpose of securing a housing to the lower surface of a work bench, shelf, or the like.

Preferably, the drawer 10 is provided with a locking member 64, illustrated in FIG. 4, which represents an important feature of this invention. The locking member 64 is provided with a recess 65 which releasably extends through the cut-out 43, as shown in FIG. 3. The locking member also has an actuating surface 66 which preferably slants downwardly so that it may be more readily pushed downwardly by the operator. It extends through the opening 43 which continues into the front wall 15 of the drawer, as shown at 68. A rearwardly extending spring member 69 rests at the bottom portion of the opening 68. The locking member may be unlocked by pressing down on the slanting surface 66. This will disengage the recess 65 of the locking member from the downwardly extending ridge 60 of the housing, thus releasing the drawer.

A preferred form of divider is shown in FIG. 5. Here the divider 95 is provided with two tabs 96 extending from the lower edge of the divider 95, each tab being reinforced by a ridge 97 extending a short distance into the divider. Accordingly, a bottom view of one of the tabs 96 and a portion of the divider 95 will look like a cross.

FIG. 5 also shows a portion of the bottom wall 14, as well as a portion of the two side walls 12 and 13. The bottom wall 14 is provided with double-chamfered openings 98 in alignment with the tabs 96. Hence, each tab 96 can be forced through its opening 98 so that the divider 95 will rest securely on the bottom wall 14 of the drawer, thus preventing a part from sliding between a divider and the bottom wall 14.

Figures 6, 7:
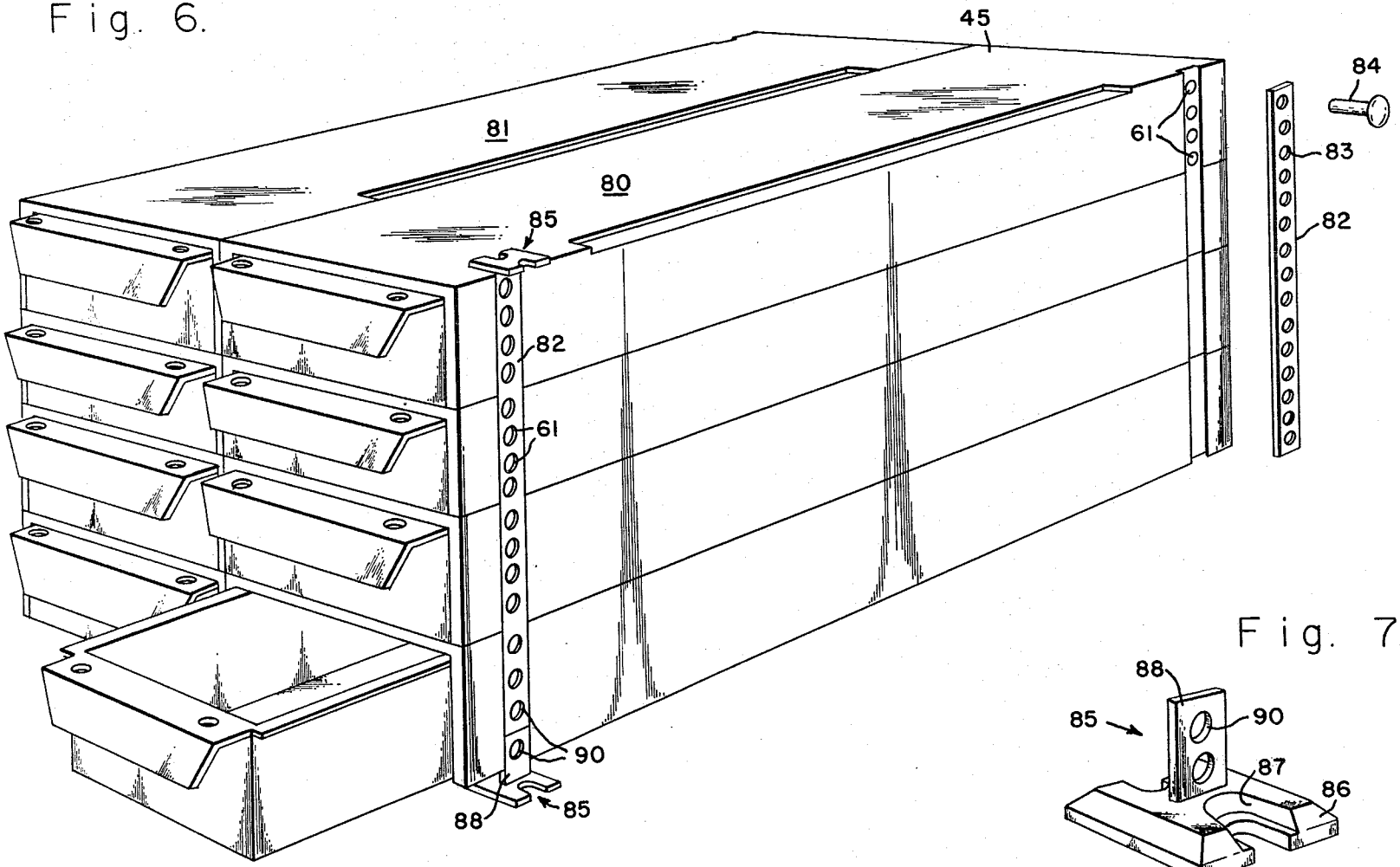
FIG. 6 is a view in perspective of a plurality of housings and drawers disposed adjacent to each other and on top of each other and including a flexible strap for interconnecting housings disposed on top of each other.
FIG. 7 is a view in perspective of a mounting foot having a plastic strap extending therefrom for securing it to a top and bottom housing as illustrated in FIG. 6.

FIG. 6 illustrates two adjacent sets of drawers and housings 80 and 81. The set 80 is disposed one on top of the other, and is interconnected by a flexible strap 82 which may, for example, consist of a suitable plastic and is provided with spaced holes 83. By means of fasteners such as so-called rivets 84, the plastic strap 82 may be secured to the holes 61 in the respective housings. This, in turn, will secure the set of housings 80 to each other.

Additionally, a mounting foot 85 may be utilized, which is shown in FIG. 7. The mounting foot 85 has a platform 86 provided wwth two opposite stepped slots 87. Extending vertically from the mounting foot 85 is a portion 88 provided with holes 90 which may, in turn, be secured to corresponding holes in one of the housings of the set 80. The foot 85 may be secured to the top wall 45 of the topmost housing by one of the slots 87. By means of another one of the stepped slots 87 the structure may be secured by a suitable fastener.

Figure 8:
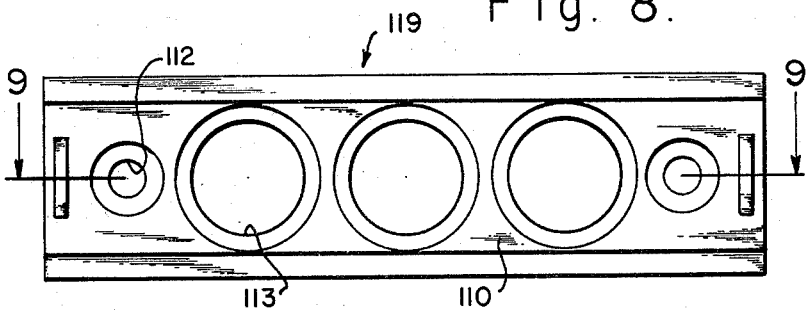
FIG. 8 is a top view of a housing mounting or supporting element of generally "U" shape.
Figure 10:
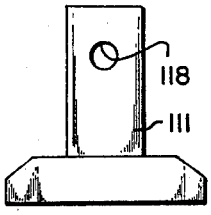
FIG. 10 is a side elevational view of an upstanding portion of the device of FIG. 8.
Figure 9:
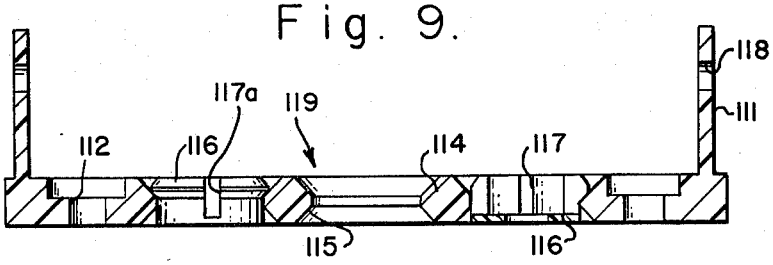
FIG. 9 is a cross-sectional view taken on lines 9—9 of FIG. 8 to show the double-chamfered apertures through the foot portion of the device of FIG. 8.

Referring now to FIGS. 8 through 13, there is illustrated in FIGS. 8 through 10 a housing supporting and mounting foot or member 119 representing another feature of the present invention. Its purpose is to secure together two adjacent housings so that they do not move apart from each other.

Figure 11:
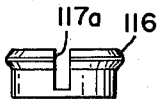
FIG. 11 is a side elevational view.
Figure 12:
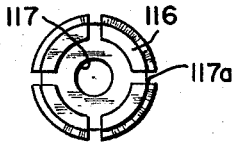
FIG. 12 is a top plan view of a bottom which may be held down by a screw to fit onto one of the double-chamfered apertures of the device shown in FIGS. 8 and 10.

FIGS. 11 and 12 illustrate a bottom which may extend through one or more of the double-chamfered openings in the flat portion of the supporting foot, for securing the housing to a horizontal member, such as the under side of a work bench, shelf, or the like.

Figure 13:
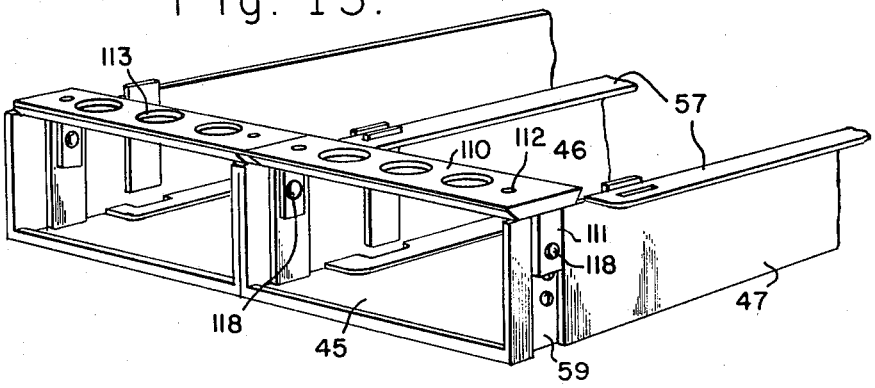
FIG. 13 is a view in perspective of two adjacent housings, shown upside down and provided with two of the locking structures of FIGS. 8 through 10.

Finally, FIG. 13 shows how the mounting foot is secured to two housings, shown upside down to better illustrate the mounting foot 119.

Referring now specifically to FIGS. 8 through 10, the supporting foot 119 has a substantially flat and horizontal portion 110 and two upwardly extending portions 111. The horizontal portion 110 may be provided with two holes 112 for accommodating a screw and its head. The portion 110 is further provided with, for example, three apertures 113 having an upper chamfered portion 114 and a lower chamfered portion 115. This makes it possible to introduce the bottom 115 of FIGS. 11 and 12, either from the top or the bottom of the locking structure 110, as illustrated in FIG. 9. The button 116 is provided with a central hole 117 for securing it to a suitable surface by a screw, now shown. Also, the upper rim of the button 116 is provided with four slots **117*a* (see particularly FIG. 12). Each of the upwardly extending portions is provided with a screw hole 118** by securing it to a housing.

FIG. 13, to which reference is now made, illustrates how the locking structure or foot 119 of FIGS. 8 through 10 may be used for securing two adjacent housings to each other. In other words, the upwardly extending portions 11 fit into the recess or groove 59 of the side wall 47 of one housing and may be secured to the corresponding recess of the adjacent housing, thereby to secure the two housings securely to each other. It is now possible to mount two or more buttons 116 on a work bench by a screw, so that the openings 113 may be pressed through the buttons to secure the housing to the top of a work bench. Furthermore, as already stated, the structure 119 will securely secure two adjacent housings to each other, as shown in FIG. 13.

It is also feasible to secure two housings disposed on top of each other by means of the foot 119 and the buttons 116. The two housings need not be lined up vertically, but may be laterally displaced. Thus, for example, the second aperture 113 of the foot 119 of one housing may be lined up with the first aperture 113 of the other foot 119 of the other housing. To this end it is feasible to provide the housing top wall 45 with apertures (not shown) rearwardly of the holes 107 and aperture 50 near the edge of the wall 45 (See FIG. 2). These apertures should be lined up with one or more of the apertures 113 of the foot 119.

The drawer 10 may be inserted into the housing 11 in two different positions. This has been illustrated in FIG. 14. The upper lateral ridges 38 of the drawer 10 are slidable in two sets of guide or alignment slots 54 and 55, previously referred to, of the projections or lateral rails 53, inside the housing walls 46 and 47. (See also FIGS. 16 and 17.) FIG. 14 shows the drawer 10 in its lower position to accommodate a relatively large part 109.

When the drawer 10 is in its lower position, shown in FIG. 14, provision may be made so that its contents are prevented from sliding out of the drawer. This has been illustrated in FIG. 15, to which reference is now made, which illustrates a closure member 102 which may be utilized when the drawer 10 is in the position shown in FIG. 14. The closure member 102 includes a vertical wall portion 103, a top portion 104, and a horizontal bottom portion 105. The top portion 104 is provided with two cut-outs 106 which, in turn, match the holes 107 (see FIG. 2) in the top wall 45 of the housing 11. On the other hand, the lower wall 105 is also provided with laterally extending projections 108 which, in turn, may be locked to the holes 18 (see FIG. 1) in the drawer 10. The parts may be locked by plastic split rivets or similar conventional fastener devices.

Figure 15:
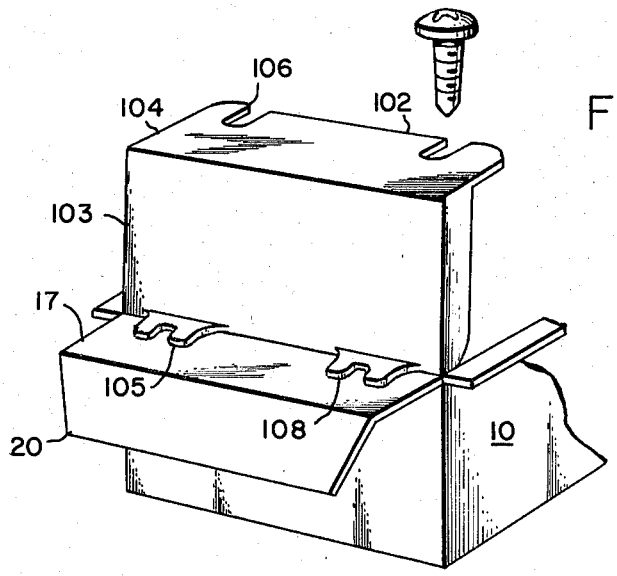
FIG. 15 is a view in perspective of an enclosure member for locking a drawer in the position of FIG. 14.
Figure 16:
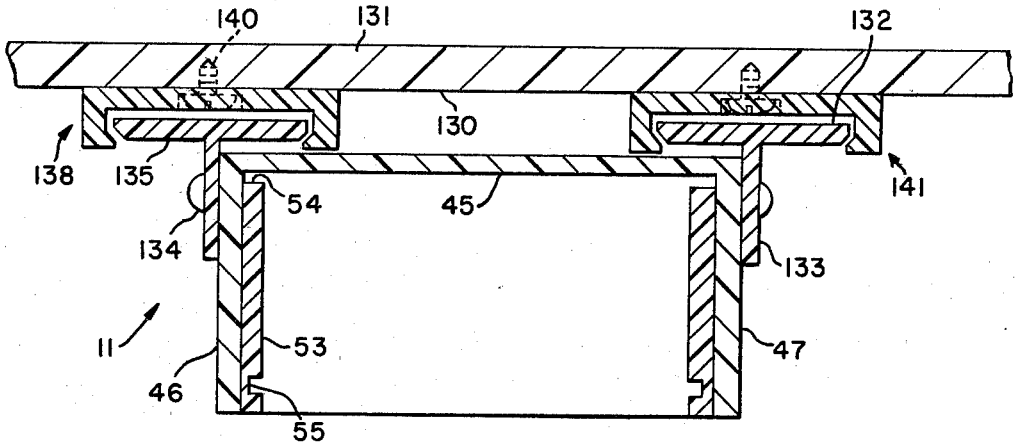
FIG. 16 is a cross-sectional view of a housing and showing a mounting device and retainer guide therefor secured to the lower surface of a bench.
Figure 17:
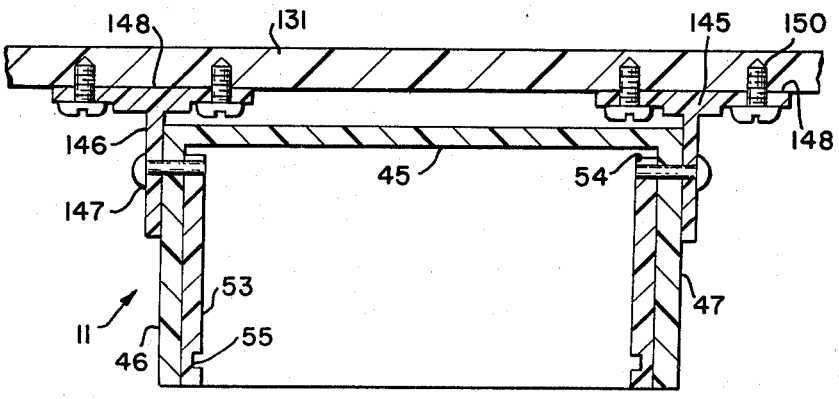

FIGS. 16 and 17 illustrate two different methods of securing a housing 11 to the lower surface 130 of a horizontal shelf 131, such as that of a work bench. As illustrated in FIG. 15, a T-shaped mounting foot 132 has a depending portion 133 which may be secured to the side wall 46 or 47 of the drawer 11 by a locking pin 134, or the like. Each of the horizontal runner portions 135 of the T-shaped feet 132 has a sliding fit within a respective retainer guide set 138, 141. The retainer guide set 138, 141 is secured to the lower bench surface 130 by screws 140.

FIG. 17 shows a single universal mounting foot 145 which has a depending portion 146 secured to the housing side walls 46 or 47 by locking pins 147. The horizontal top portion 148 of the mounting foot is secured to the lower bench surface 130 by screws 150.

Figure 18:
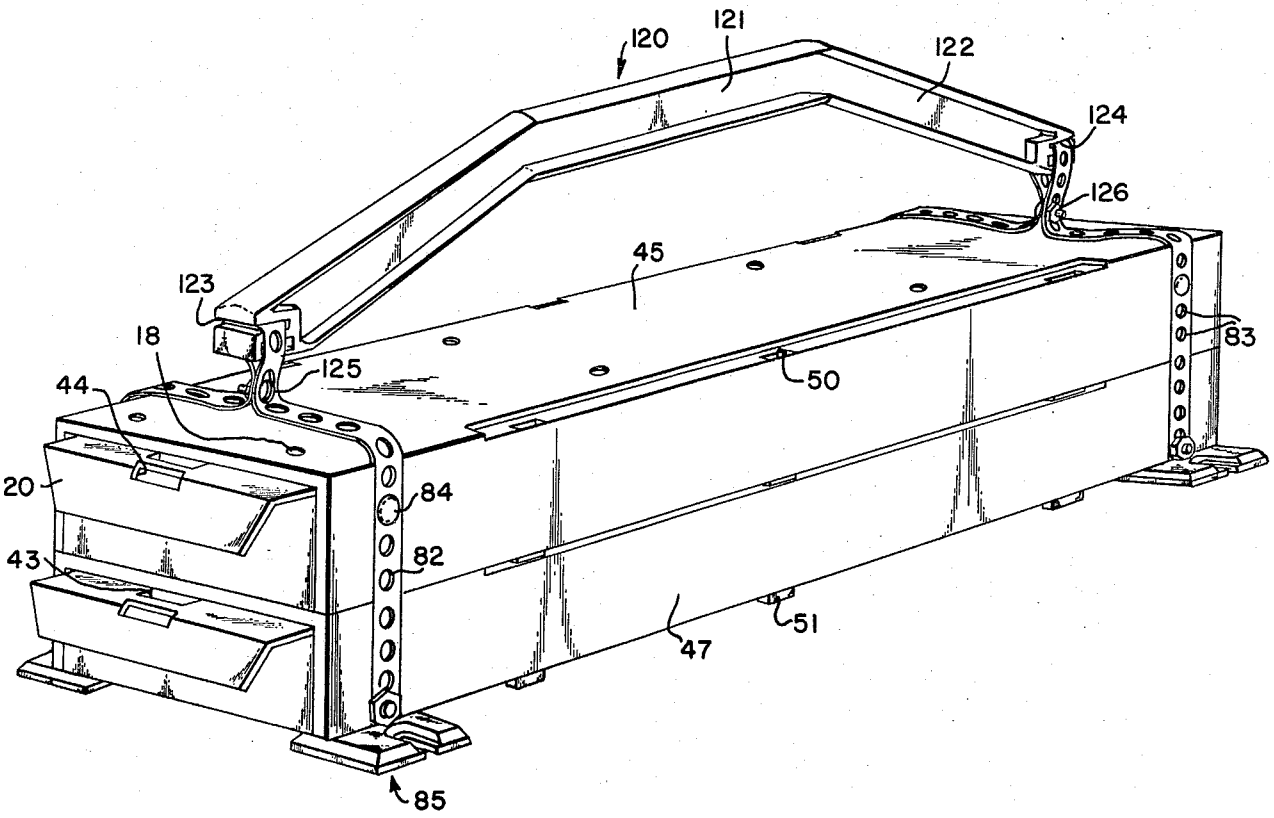
FIG. 18 is a view in perspective of two assembled housings and drawers put on top of each other and including a handle and strap for hand-carrying the assemblage.

It is also possible, in accordance with the present invention, to hand-carry a stack of assembled housings and drawers. This may conveniently be done by means of a special handle. Such as embodiment has been illustrated in FIG. 18, to which reference is now made.

Here, two housings and associated drawers stacked on top of each other are illustrated. While this figure does not illustrate the locking member 64, it shows the cut-outs 43 and 44 in the horizontal drawer position and in the inclined drawer handle 20. The two housings are strapped together by a strap 82, as previously described in connection with FIG. 6, the straps having properly spaced holes 83. The straps may be secured to the housing wall by means of a rivet 84 or the like. Also, the straps may be properly secured to the foot 85 previously described in connections with FIGS. 6 and 7.

Preferably the two straps form an upwardly closed loop and are secured together by a plastic screw 125 and nut 126 so as to provide a reasonably tight structure about the two housings.

A handle 120 serves the purpose of carrying the structure. The handle has a horizontal portion 121 for carrying it, and two downwardly extending portions 122. At the outer end of each portion 122 there is provided a slot 124 of sufficient width to accept the upper loop of the strap 82. As clearly shown, the front portion of the slot 124 is relatively narrow, as shown at 123, so that the strap has to be forced through the narrow slit 123 into the relatively wider slot 124.

It should be noted that the handle 122 has an extended upper and lower section with a reduced middle portion, to reduce its width while giving it sufficient strength.

Referring not to FIG. 19, there is illustrated an adapter bracket and wall mount for mounting the housing 11 to a wall. Thus, the adaptor bracket 70 may have an extension 71, which may be secured to one of the holes 61 by a fastener such as a rivet 72 or the like. The adaptor bracket 70, which is of generally rectangular construction, may be fitted or slid into a wall mount 73 having lateral walls 74 forming a recess or guide 75 into which the bracket 70 fits. The bracket, in turn, is retained by a lower extension 76 against which it fits. The wall mount may be secured to the wall, for example, by screws 77.

Referring now to FIG. 20, this again shows a set 80 of vertically aligned housings and drawers. The horizontal extension 35 at the rear of each drawer 10 is provided with a central aperture 36 (see also FIG. 1). A locking rod 92 may extend through the openings 36 of the set of drawers. The locking rod 92 may have a top button 91, so that it will not slide through the hole 36, and a padlock 94 at the other end. This will permit either to lock the drawers so that they cannot be opened, or else to carry the assembly from place to place without the inadvertent opening of drawers and spilling of their contents.

The handle 120 may be made of a suitable plastic. It should be noted that the support foot 119 may, for example, be made of Delrin, which is an acetal resin. The bumper 62 may consist of a polypropionate which has a cellulose base.

There has thus been disclosed a system for storing parts such as product packaging parts. The system includes a modular set, each consisting of a housing and a drawer. The sets may be put on top of each other and/or adjacent to each other. Each drawer may be removably loaded by a plastic locking member to its associated housing. Means, such as a mounting or supporting foot, are provided for locking each housing to an adjacent housing, and for restraining sets of superimposed housing. Also, two adjacent sets of housings are locked together to prevent lateral separation. Both housing and drawer are made of transparent plastic and hence are inexpensively manufactured. The drawers may be provided with different types of removable dividers. A preferred type of divider is provided with two tabs at the bottom, which have a press fit with suitable chamfered openings in the bottom wall of the drawer. This, of course, will secure a tight fit between the bottom of the divider and the drawer bottom wall. The drawers may be inserted into an upper or lower portion of the housing. In the latter case, a closure member may be provided to close the opening formed between the housing and the drawer.

What is claimed is:

1. A modular storage system for product packaging parts comprising:

(a) a plurality of housings;

(b) a drawer for each of said housings;

(c) each of said housings including a top wall and two parallel side walls, said top wall having a plurality of alignment slots adjacent said side walls, and alignment tabs extending downwardly from each of said side walls and registering with alignment slots of a housing disposed thereabove;

(d) each of said housings having along its side walls vertically extending recesses at each end;

(e) each of said drawers having a bottom wall and two side walls, a front wall including a first horizontally extending portion and an outer portion downwardly extending at an obtuse angle with respect to said first portion, for gripping and withdrawing the drawer, and a rear wall; and (f) a locking member extending through a substantially rectangular cut-out in said first drawer portion, and an opening between said first drawer portion and said outer drawer portion, said locking member having a recess to snap into a downwardly extending ridge on the front end of said housing top wall, an actuating button extending through said cut-out, a retaining portion of said member having a tight fit with said opening, and a rearwardly extending spring member of said locking member resting on an extension of said cut-out in said drawer front wall for releasably securing said drawer to an associated housing.

2. A system as defined in claim 1 wherein said actuating button of said locking member has a top surface sloping rearwardly to provide a button actuating surface for the operator opening the drawer.

3. A system as defined in claim 1 wherein at least one divider is provided for each of said drawers, vertical guide members being disposed on the inner surface of each of said side drawer side walls and in alignment with each other for retaining said divider, said divider having two tabs extending from the bottom of said divider and having an enlarged end portion, and said drawer bottom wall having two openings aligned with said tabs, each of said openings having a reduced central portion and enlarged upper and lower portions, so that said tabs can be forced through said opening and retained thereby.

4. A system as defined in claim 3 wherein said divider is provided with a pair of ridges, each pair being aligned with one of said tabs for providing a reinforcement.

5. A system as defined in claim 1 wherein a divider is provided for each of said drawers, the inner surface of each of the side walls of said drawer being provided with two vertical guides disposed in alignment with each other, and a divider having a thickness to fit between said guides, said divider having a small central opening and radial slots extending outwardly from said opening and terminating in a circle, said opening and radial slots being arranged to pass therethrough a cylindrical or conical product which otherwise may not fit within said drawer and divider.

6. A system as defined in claim 1 wherein a divider is provided for each of said drawers, each of the side walls of said drawer being provided with two vertical guides disposed in alignment with each other, and a divider having a thickness to fit the space between said guides, said divider having a cylindrical extension for supporting therein a cylindrical product to be housed in said drawer.

7. A system as defined in claim 1 wherein a mounting a supporting foot is provided, said foot being of generally "U" shape, with up-standing portions, said housing being provided on the outside of its outer walls with vertically arranged recesses for accepting said foot, thereby to secure two adjacent housings securely to each other.

8. A system as defined in claim 7 wherein mounting holes are provided on each of said up-standing portions and on the main portion adjacent to said up-standing portions for securing said foot to said housing and to a horizontal surface.

9. A system as defined in claim 8 wherein the main portion of said foot is provided with a plurality of apertures, each of said apertures having an upper and a lower chamfered portion for receiving a mounting button either from above or from below, said mounting button being capable of being secured to a horizontal surface.

10. A system as defined in claim 1 wherein said housing is provided with a plurality of holes along its vertical walls adjacent to the ends thereof, said holes being provided in a corresponding vertical recess, and a flexible strap having a plurality of openings to match the holes in said housing, means for securing said strap to said housing, and a handle secured to said strap.

11. A system as defined in claim 10 wherein means are provided for securing the two ends of said strap arranged about one or more of said housings closely adjacent to the top wall of the uppermost housing.

12. A system as defined in claim 10 wherein said handle has a horizontal gripping portion and two downwardly extending portions, the ends of each of said downwardly extending portions being provided with a slot for receiving said strap and an outer slit having such a width that said strap has to be forced into said slot.

13. A system as defined in claim 1 wherein each of said drawers on its rear wall is provided with an outwardly extending bumper, thereby to protect the drawer and prevent accidental opening of the drawer from the housing.

14. A system as defined in claim 1 wherein each of said housings is provided on the inside of its side walls with two sets of vertically extending lateral rails, each of said rails being provided with two guide recesses extending horizontally and disposed one above the other, thereby to permit the associated drawer to be inserted into one of two vertically spaced portions.

15. A system as defined in claim 14 wherein a closure member is provided for said drawer, for protecting large products when said drawer is inserted into the lower portion of said housing, said closure member having a horizontal portion adapted to be secured to the top wall of its drawer, a vertical portion for closing said drawer and a horizontal portion capable of being secured to said horizontally extending portion of said drawer.

16. A system as defined in claim 1 wherein means are provided for securing said housing to a horizontal surface of support.

17. A system as defined in claim 1 wherein means are provided for securing said housing to a vertical wall.

* * * * *